United States Patent [19]

Welsh

[11] 4,200,087

[45] Apr. 29, 1980

[54] REMOVABLE FLOW DIRECTOR FOR KITCHEN EXHAUST SYSTEM

[75] Inventor: Clarke T. Welsh, Logansport, Ind.

[73] Assignee: Logansport Distributors Inc., Logansport, Ind.

[21] Appl. No.: 876,743

[22] Filed: Feb. 10, 1978

[51] Int. Cl.[2] ..... F24C 15/20

[52] U.S. Cl. ..... 126/299 R

[58] Field of Search .... 126/299, 299 R, 299 C–299 F, 126/300, 301; 98/115, 115 R, 115 B, 115 LN, 115 SB

[56] References Cited

U.S. PATENT DOCUMENTS

| | | | |
|---|---|---|---|
| 514,003 | 2/1894 | Hornor et al. | 126/299 D |
| 1,465,652 | 8/1923 | Moore | 126/299 D |
| 3,890,887 | 6/1975 | Kaufman et al. | 126/299 D |
| 3,897,046 | 7/1975 | De Weese et al. | 98/115 R |
| 3,978,777 | 9/1976 | Nett | 126/299 D |

*Primary Examiner*—Albert W. Davis
*Assistant Examiner*—Wesley S. Ratliff, Jr.
*Attorney, Agent, or Firm*—Woodard, Weikart, Emhardt & Naughton

[57] ABSTRACT

A kitchen exhaust system has an outside air supply blower and a hood exhaust blower discharging outside the building. Air is introduced from the supply blower into the area behind the cooking unit and the exhaust is taken through a removable flow director or guide secured to the typical exhaust hood. The flow guide has an inlet located toward the front of the cooking unit and relatively near the top of the cooking unit and has convenient release devices to facilitate removal of the guide from the hood to facilitate removal and replacement of filters or grease removing devices from their usual disposition in the hood assembly. The shape of the flow director is such as to provide a high velocity of the fluid flow adjacent the intake opening and thereby provide more effective scavenging action for combustion products and cooking fumes than is typically found with an exhaust unit unassisted by the flow director of the present invention.

29 Claims, 11 Drawing Figures

REMOVABLE FLOW DIRECTOR FOR KITCHEN EXHAUST SYSTEM

BACKGROUND OF THE INVENTION

1. Field of the Invention

This invention relates generally to kitchen exhaust systems and more particularly to a system by which performance of existing types of range hoods and kitchen exhaust units is materially improved.

2. Description of the Prior Art

Many and various types of devices have been conceived for kitchen exhaust functions. Some of them have been mentioned in my co-pending application Ser. No. 675,762 filed Apr. 12, 1976. Others have been cited as references in that application. Some have used devices to force outside air through a relatively narrow longitudinal slot in a fast moving narrow stream toward the exhaust inlet to form an air curtain across the fume chamber. Examples are the Jensen U.S. Pat. No. 3,386,365 and Nett U.S. Pat. No. 3,978,777. Various shapes and locations of air inlets and outlets have been devised. Nevertheless, with the recent and increasing emphasis on energy conservation, there has remained a need for improvement of removal of fumes from cooking units, using the same or less volumes of air introduced from outside the building, not only to conserve on the amount of energy used to heat or cool make-up air (depending upon ambient conditions outside the building) but also power requirements of air handling equipment. The present invention is the result of further efforts toward solutions of the existing problems.

SUMMARY OF THE INVENTION

Described briefly, in a typical embodiment of the present invention, a kitchen exhaust hood is connected to an exhaust blower and fresh air supply blower. The fresh air supply is introduced, at least in part, at a level below and behind the top of the cooking unit. The normal exhaust intake of the hood is above and extends to the rear of the area above the top of the cooking unit. It includes grease removal devices. An air flow director is connected to the hood and disposed on the underside of it between the top of the cooking unit and the air exhaust inlet. It is readily removable in order to permit access to the grease removal units. It is arranged to provide a very high velocity of air adjacent the inlet which is located comparatively near and approximately centrally above the top of the cooking unit. A comparatively high velocity of air and exhaust fumes is thereby established adjacent the inlet to the flow director, while a comparatively low air velocity is maintained adjacent the inlets to the grease removal means.

DESCRIPTION OF THE PREFERRED EMBODIMENT

Figure 1:
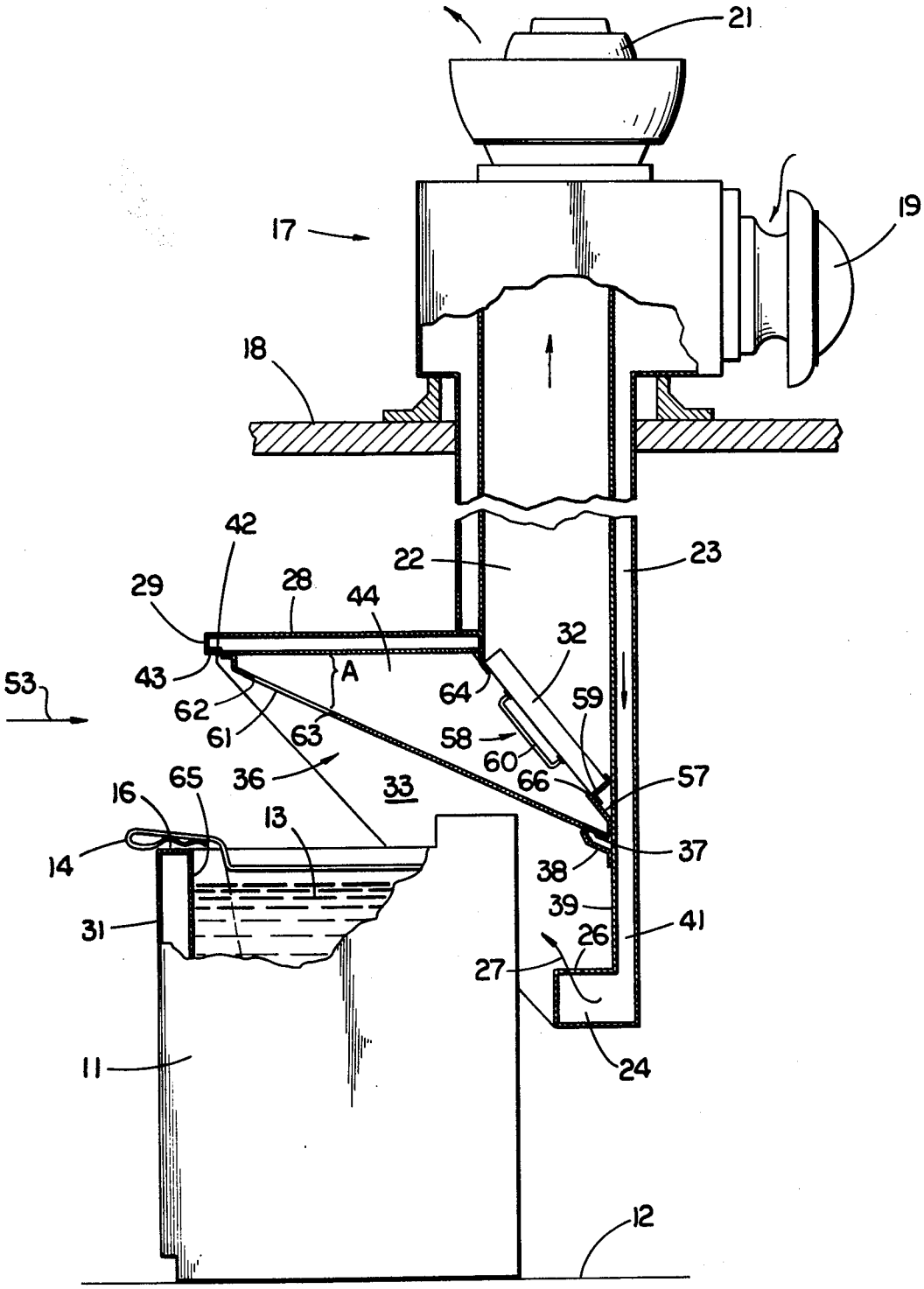
FIG. 1 is an elevational view, partially in section, of a cooking unit with the kitchen exhaust unit above and behind it and showing in vertical section the flow director in accordance with one embodiment of the present invention.

Referring now to the drawings in detail, and more particularly to FIG. 1, a deep fat frying unit 11 is shown mounted on the kitchen floor 12 and having a cooking basket 13 therein with the handle 14 resting on the top front edge 16 thereof.

An air handling unit 17 is mounted to the kitchen roof 18 and includes a fresh air supply blower 19 and an exhaust blower 21. The exhaust blower takes combustion products and contaminants and air up through a pipe 22 and exhausts it to atmosphere. The supply blower 19 takes air from the atmosphere and supplies it downward through a duct 23 coaxial with the duct 22 to a lower plenum 24. This plenum has a discharge slot 26 facing upwardly from which air supplied by the blower is discharged upwardly and forwardly in the direction of arrow 27. A hood 28 extends well over the top of the cooking unit although the front edge 29 of the hood does not extend to a vertical projection with the front edge 31 of the cooking unit. Grease removal devices 32 are mounted in the inlet to the exhaust duct 22. A pair of side "curtains" are provided at each side of the hood to minimize "rollout" of smoke and fumes. An apparatus having some similarities to those described here has been disclosed in my above mentioned patent application. The concentric supply and return is shown in a U.S. Pat. No. 3,645,194.

According to the preferred embodiment of my present invention, a flow director 36 is mounted to the kitchen exhaust assembly. It includes a lower rear edge 37 received in a grease trough 38 fastened to the front of the splash panel 39 which serves also as the front wall of the air supply conduit 41 extending the width of the rear of the assembly and supplying the lower plenum 24. The flow director has an upper front marginal flange 42 received on the inwardly and rearwardly extending lower flange 43 at the lower margin of the front face 29 of the hood 28. Thus it is seen how the flow director is mounted at the front and rear edges.

Figure 2:
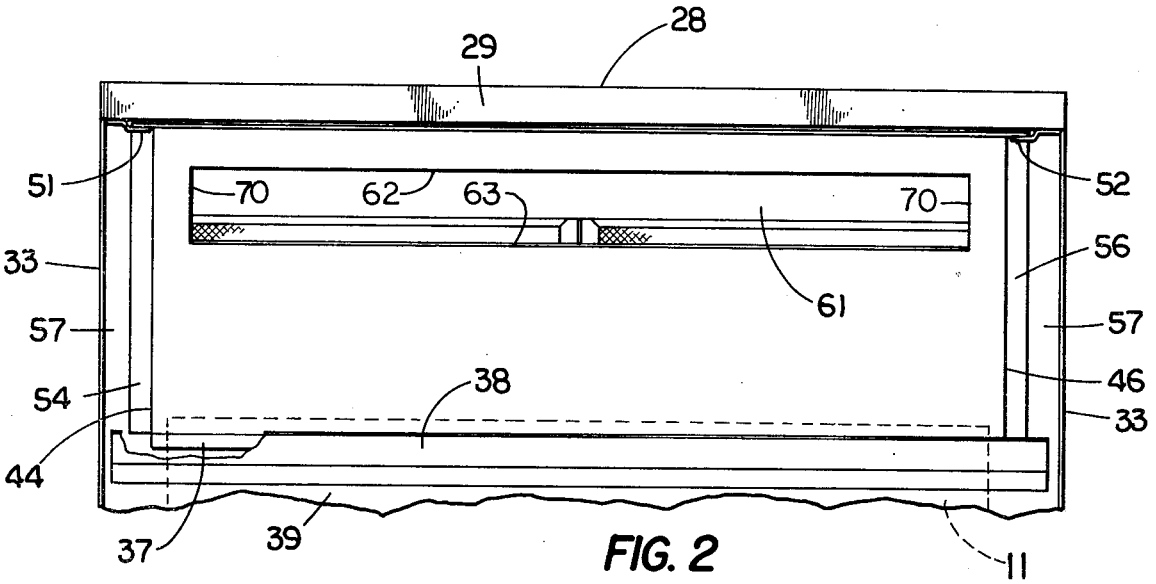
FIG. 2 is a fragmentary front elevational view of a portion of the hood assembly and showing the flow director installed.
Figure 3:
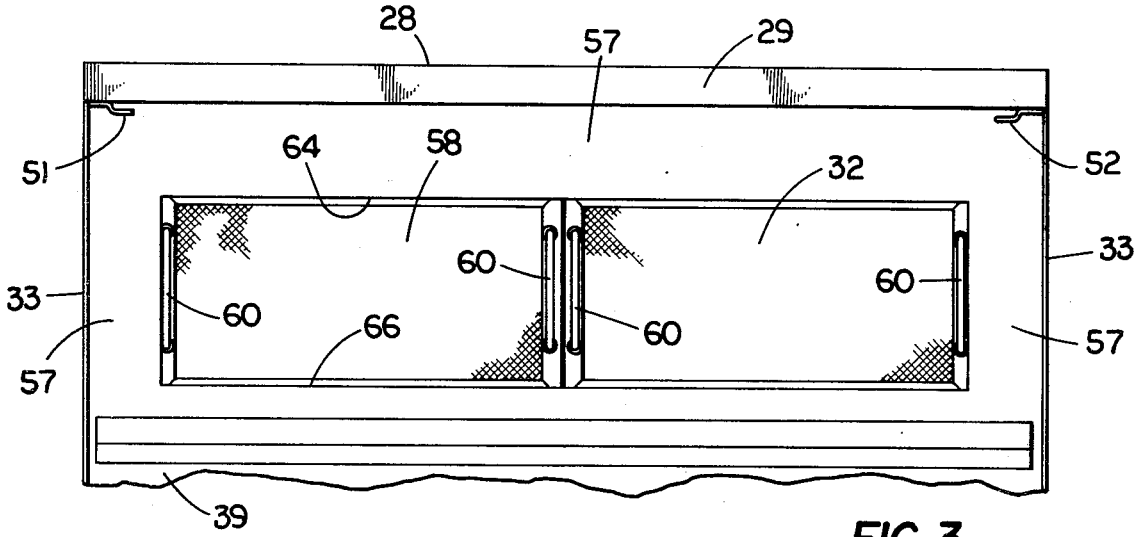
FIG. 3 is a fragmentary front elevational view with the flow director of the present invention removed, and showing the grease removal devices.
Figure 4:
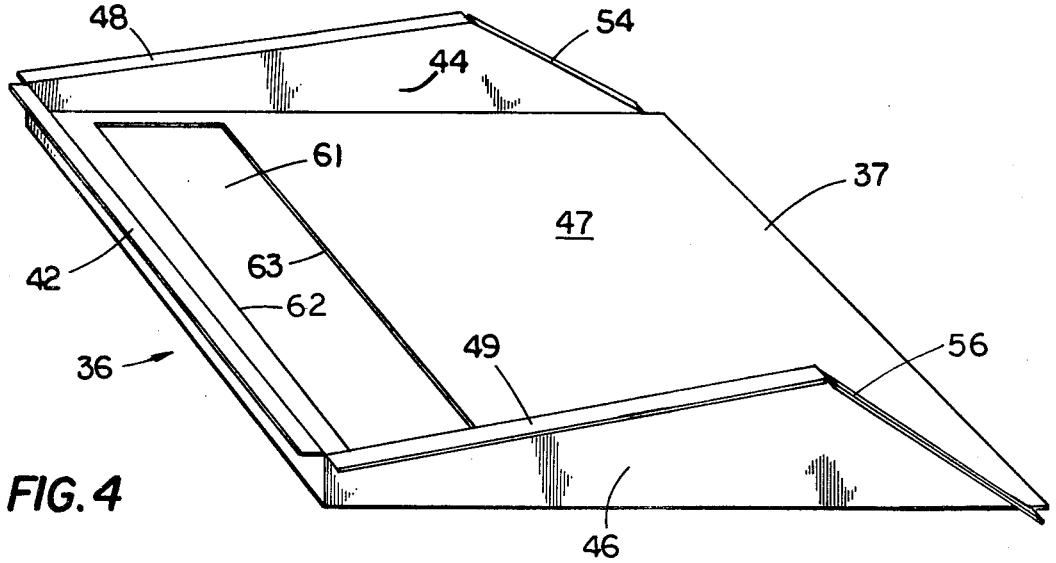
FIG. 4 is a perspective view of the flow director.

Reference to FIGS. 2 through 4 will assist in an understanding of the flow director where there is shown a pair of side walls 44 and 46 (parallel to and spaced inwardly from side curtains 33), a bottom wall 47 and left and right upper frontal side flanges 48 and 49, respectively. As shown in FIGS. 2 and 3, a pair of tracks 51 and 52 are affixed to the underside of the hood 28 and extend rearwardly. These receive the left and right hand side flanges 48 and 49 of the flow director as it is installed under the hood in the direction of arrow 53 (FIG. 1). They retain it securely at the sides while the rear side flanges 54 and 56 abuttingly engage the inclined or vertical rear wall 57 of the hood assembly. This wall 57 has the inlet opening 58, and the grease removal devices 32 are mounted on the upper face of this wall and are supported thereon and by the retainer strip 59 secured to the rear face of the wall 57 near the lower edge of the opening 58. Grease removal devices such as shown in the U.S. Pat. No. 3,566,585 may be used in this location and may have handling rings or handles 60 (FIG. 3) in them to facilitate their removal from the unit for cleaning. Nominal dimensions typically used are 10 inches (high) by 20 inches (wide). Other types of grease removal devices might also be used.

The illustrated flow director has an inlet opening or slot 61 extending substantially the entire width of the device and located near the front end of it. Thus, in effect, it divides the bottom of the flow director into a front and rear crossmember serving to space the sidewalls. In addition, being frontally located as shown best in FIG. 1, it provides a clearance space "A" of a comparatively small dimension between the underside of the hood 28 and the rear edge 63 of the inlet slot. This dimension is preferably less than half the dimension from the upper edge 64 to the lower edge 66 of the exhaust inlet opening 58. The edge 63 is preferably located about 16 inches above the top of the cooking unit. The front edge 62 of the slot 61 should be less than 12 inches behind the vertical upward projection of the front (e.g. 65) of the fume producing portion of the cooking unit. Neither of these distances is critical, and the present invention is effective with various hood-to-cooking unit dimensions.

The width of the flow director from the wall 44 to the wall 46 can be as great as desired consistent with the width of the cooking devices being employed. For example, if there is a single deep frying unit of the gas or electric type as shown in FIG. 1, it can be just slightly wider than such unit and perform quite adequately. For example, it could be six inches wider overall than the cooking unit and perform very suitably. On the other hand, if it is a complete cook top for service as a grill, then the flow director would be considerably wider. In such event, the slot may be briefly interrupted at spaced points along its length by strengthening webs (forward extensions of bottom wall 47) from the rear edge 63 to the front edge 62 of the slot. Also it should be recognized that instead of a single slot having a substantial dimension from the front edge 62 to rear edge 63, a plurality of parallel narrower slots could be used at the same location. In any event, the objective is to accelerate the air flow over and proximate the cooking area so that the velocity at the location "A" may be from 600 to 1200 feet per minute while the velocity in the conduit formed by cooperation of the flow director with the hood, and with the filter support wall 57 and the faces of the grease remover devices 32 at a location immediately upstream of those devices, would be between 200 and 400 feet per minute. It has been found that the high velocity is extremely effective in removal of the combustion products and fumes, and yet the low velocity immediately ahead of the grease removal devices enables them to perform adequately in their intended function of grease removal. The fact that the flow director projects outwardly from the actusl inlet to the exhaust conduit or duct 22 has resulted in the flow director being conveniently referred to as a snorkel. Since the grease removal devices typically require periodic attention for cleaning of them, this embodiment of the flow director can be readily removed by sliding it toward the front in a direction opposite arrow 53 as it is guided on its way out by the side flanges 48 and 49 in the tracks 51, 52, respectively, of the hood.

Figure 5:
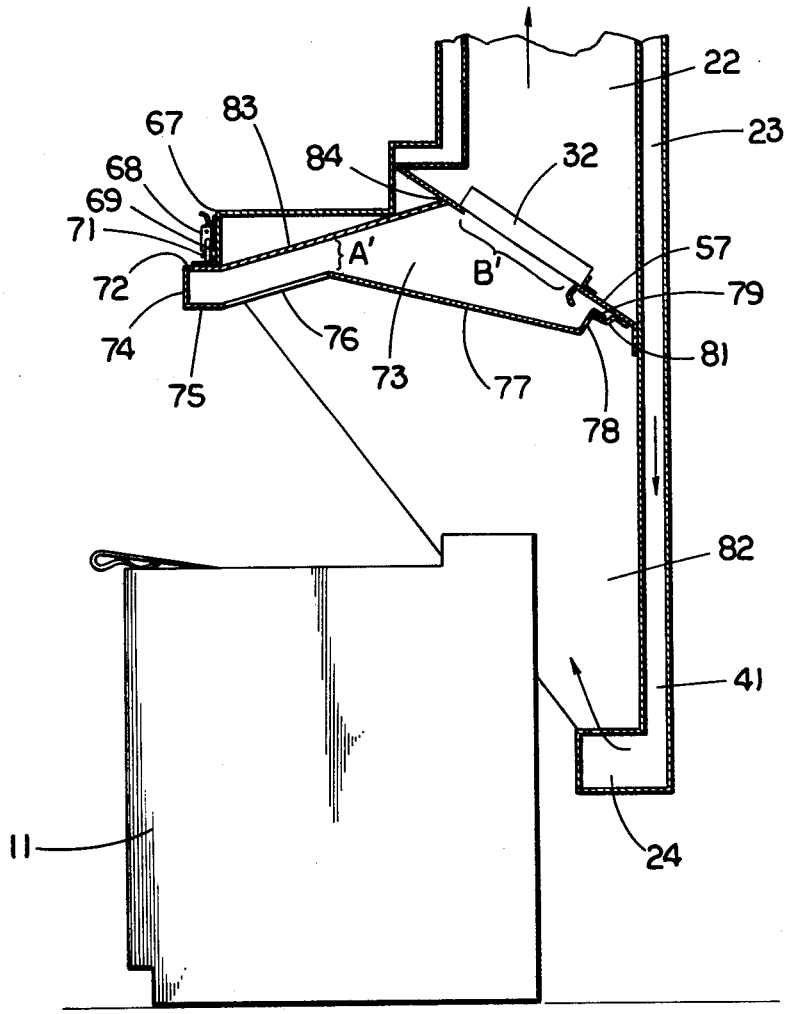
FIG. 5 is a view similar to FIG. 1 but showing an alternate embodiment of the present invention.

Referring now to FIG. 5, an alternate embodiment is shown wherein like parts are given the same reference numerals as in FIG. 1. In this embodiment, the shape of the hood is somewhat different and the front wall 67 has at least a pair of over/center latches 68. Each of these latches includes a ring 69 received under a hook 71 secured to the upper face 72 of the front crossmember of the flow director. The side wall 73 of the flow director has a somewhat different shape than in the embodiment of FIG. 1 because of its inclusion of a vertically extending front end joining the front wall 74 of the front crossmember of the flow director, the lower frontal edge 75 joining the bottom of the front crossmember of the flow director, the upwardly and rearwardly extending inclined portion 76 adjacent the intake slot, and the lower rear marginal portion 77 extending rearwardly and downwardly from the slot to the rear marginal portion 78 immediately adjacent the rear end bottom flange 79 received in the grease trough 81 on the filter mounting wall 57 of the assembly. Side curtains or shrouds 82 are provided on the assembly in a manner similar to that of FIG. 1, although the shape is somewhat different.

In the particular embodiment of FIG. 5, in order to achieve the high relative velocity as discussed above with reference to FIGS. 1 through 4, there is a filler wall 83 provided from the lower edge of the front wall 67 of the hood to the front face of wall 57 at the line 84. In this way, the dimension A' in FIG. 5 is very small by comparison with the corresponding dimension B' at the inlet to the grease removal devices 32. Therefore, in this embodiment as in the previously described embodiment, a very high flow velocity is obtained at the location A' whereas the velocity can decrease to an acceptable level at the location B'.

As discussed above with reference to the first embodiment, the width of the unit from the wide wall 73 to the opposite side wall parallel to it can be whatever is desired to be compatable with the cooking unit which is to be serviced by the exhaust unit.

Referring now to the embodiment of FIGS. 6 through 11, FIG. 6 shows the fryer 11 mounted in front of a floor mounted exhaust assembly 86. This exhaust assembly includes a rear wall 87, a forwardly sloping upwardly extending front wall 88, a lower front wall 89, a lower plenum 91 and upper plenum 92. The lower plenum is separated from the upper plenum by an intermediate wall 92. The hood 94 extends forwardly over the top of the cooking unit and has a lower face 96. At the rear wall 97 of the hood, there are openings extending horizontally and through which the combustion products and fumes from above the cook top can pass to enter the grease removal devices 32 which are supported in a channel 98. A removable grease tray 99 is disposed under the channel 98 and rests on the top ledge 101 immediately above the upper margin of wall 88. A slot 102 is provided between the lower margin of wall 88 and the lower front wall of the exhaust assembly and provides for discharge of air upwardly from the supply air plenum 91 in the direction of arrow 103 (FIG. 6) along the wall 88 and through the space 104 between the rear wall 106 of the cooking unit and wall 88 into the space 107 above the cooking unit. A removable perforated screen 108 is provided above the slot 102.

Figure 7:
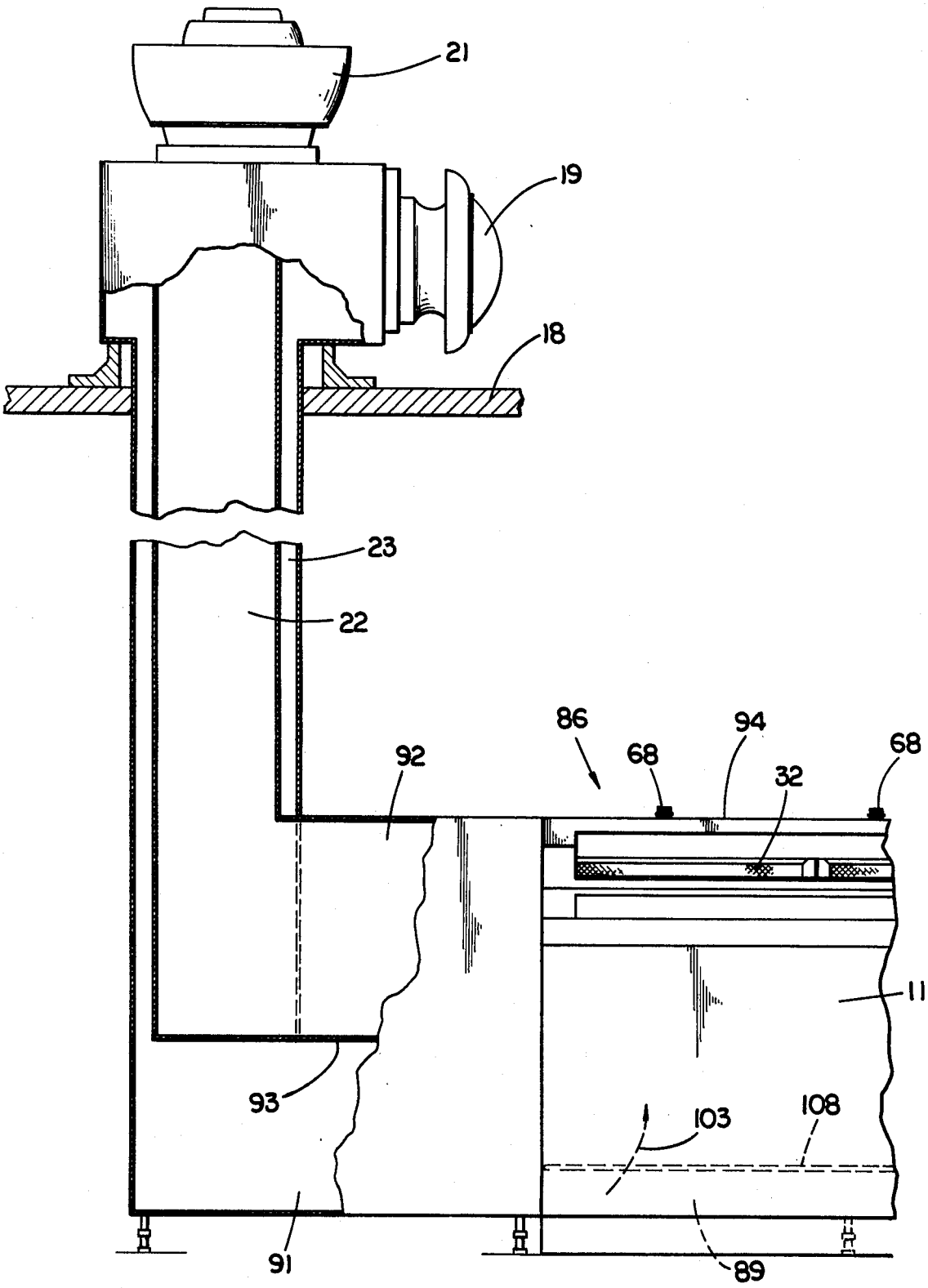
FIG. 7 is a front view of the type of kitchen exhaust assembly shown in FIG. 6.
Figure 9:
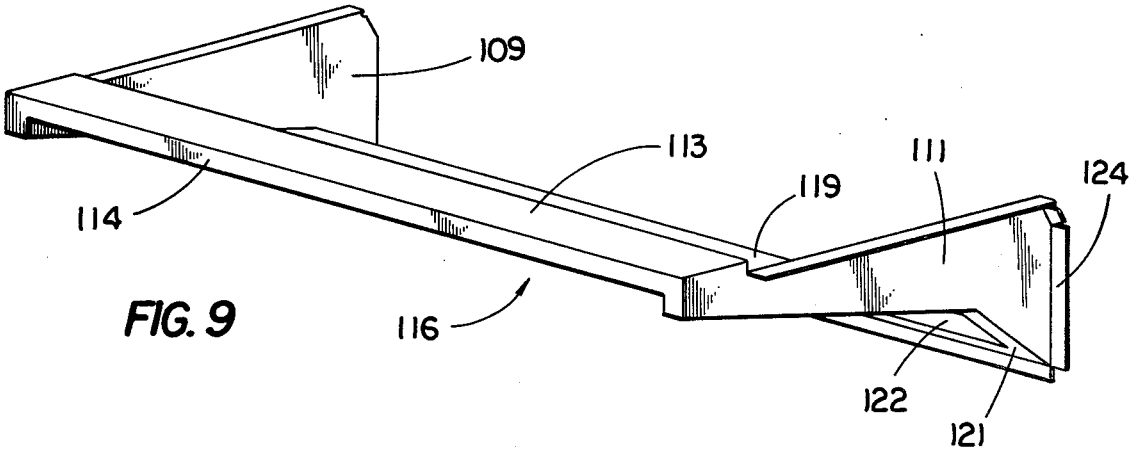
FIG. 9 is a perspective view of the flow director of the embodiment of FIGS. 6 and 8, but removed from the exhaust assembly.
Figure 10:
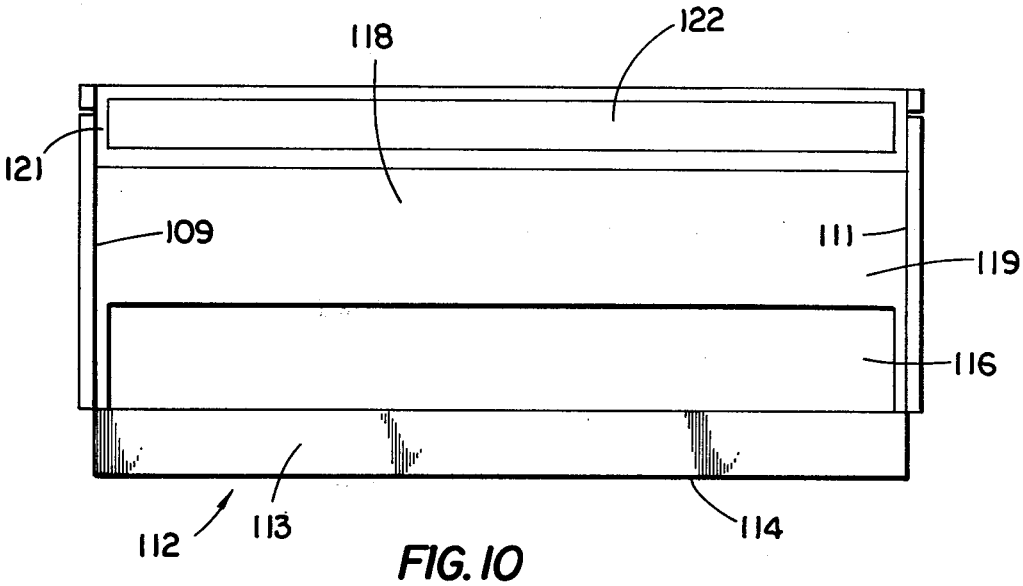
FIG. 10 is a top plan view of the flow director of FIG. 6.
Figure 11:
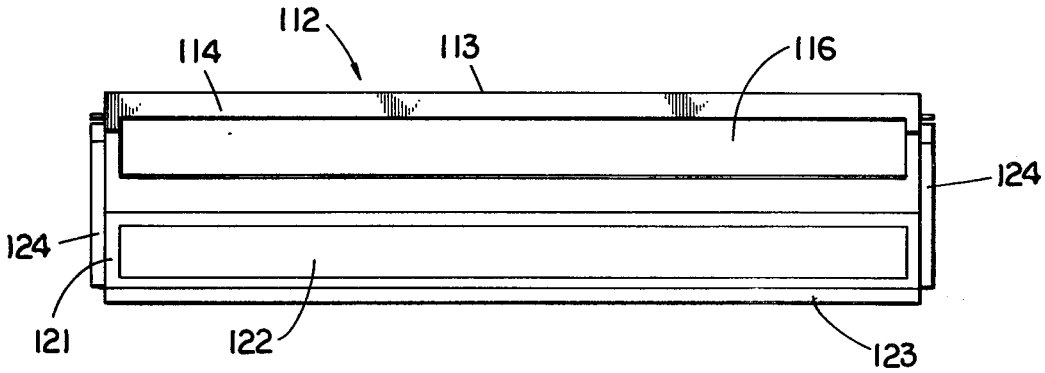
FIG. 11 is a front elevational view of the flow director of FIG. 6.

FIG. 7 shows a way of handling the air for the exhaust assembly 86. In this fragmentary front view, it is seen that the exhaust air plenum 92 is connected to the center duct 22 while the supply air plenum 91 below the partition 93 is connected to the coaxial conduit 23. The conduits 22 and 23 may be connected to blowers 21 and 19 in the same way as discussed above with reference to FIG. 1.

Figure 8:
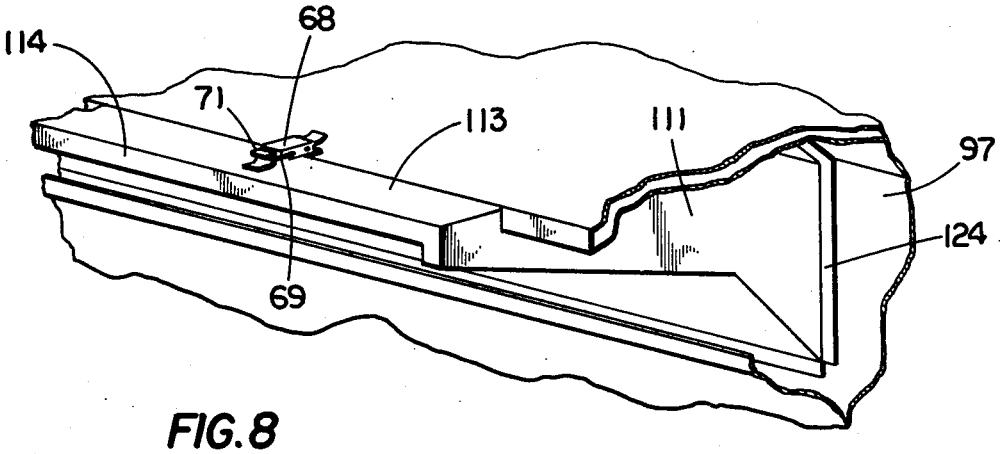
FIG. 8 is a fragmentary perspective view of the flow director installed according to the embodiment of FIG. 6.

In the embodiment of the snorkel of FIGS. 6 through 11, there are the side walls 109 and 111, a front crossmember at 112 including the top portion 113 and front portion 114, the slot 116 and a bottom crossmember 118 having two discrete portions, the forward portion 119 being on a comparatively slight slope and the rear portion 121 being on a steeper slope and possibly including a central removable panel 122. A vertical flange 123 is at the lower rear margin of the bottom crossmember 121 and is received in the filter support channel 98 immediately in front of the grease removal device 32. It is in this way that the snorkel is supported at the rear, while the front of it is supported by a pair of horizontally spaced over/center clamps 68 of the same kind as discussed above with reference to FIG. 5. The rings 69 of these clamps are received in hooks 71 mounted on the upper wall 113 of the front crossmember as is best shown in FIG. 8. Outwardly extending flanges such as 124 are provided at the rear margins of each of the side walls 109 and 111 and abut the wall 97 of the exhaust assembly immediately adjacent the grease removal devices.

Figure 6:
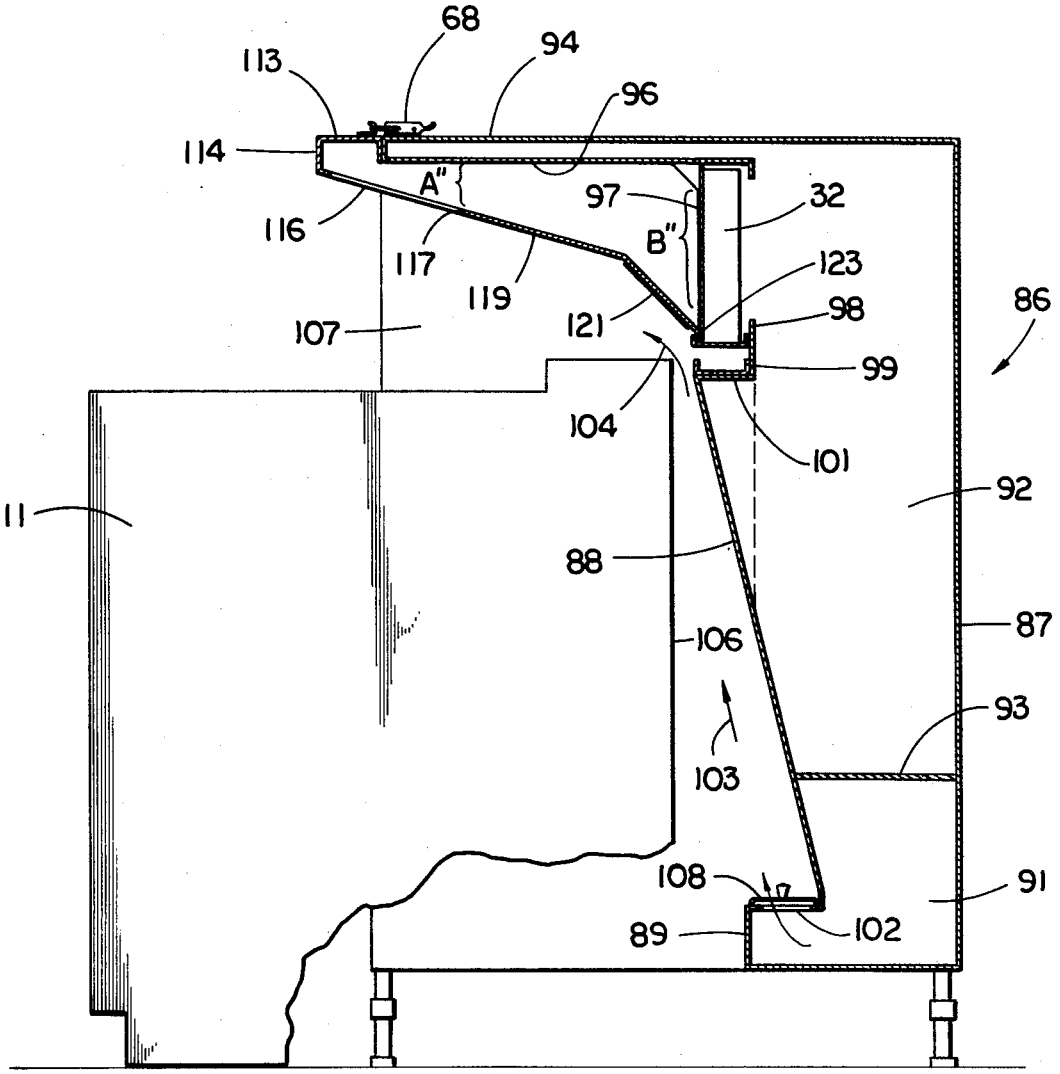
FIG. 6 is a view similar to FIG. 1 but showing a second alternate embodiment of the present invention.

As can be best seen in FIG. 6, the dimension A″ between the lower face 96 of the hood and the rear edge 117 of the slot 116 is considerably smaller than the dimension B″ at the inlet to the grease removal devices 32. Since the width of slot 116 from side to side is about the same as the overall width of the inlets to the grease removal devices facing the duct formed by cooperation of the snorkel with the hood, and the ratio of dimension B″ to A″ is in excess of 2, the velocity of air at A″, is twice that at B″, the latter being within the normal acceptable range of air velocity at the inlets to grease removal devices. As discussed above, this achieves an unusually effective scavenging of combustion products from above the cooking unit. Also, as mentioned above with reference to the other embodiments of the snorkel, the horizontal spacing of the walls such as 109 and 111 for this embodiment can be as great as needed to accommodate the cooking devices to be employed with the hood. One example is 43 inches. In the same example, the overall height from the uppermost point 113 at the front crossmember to the lowermost point at the lower edge of rear flange 123 would be about 7¾ inches. The overall length from the wall 97 to the front 114 would be 20½ inches. The overall height at the front wall 114 would be 2⅛ inches. These are just examples, the object being the low ratio of flow area adjacent the intake slot 116 to the flow area in front of the grease removal devices so that, consistent with maximum utilization of the removal devices at the highest acceptable velocities for them, extremely high velocities can be achieved over the cooking unit. For the various embodiments, the ratio of grease remover areas to inlet areas adjacent the slot may be as much as 6, depending on dimensions of a particular installation. By appropriate location of the rear edge of the inlet, with respect to the underside of the hood, the desired ratios can be achieved even in instances where the width of a slot from side-to-side (70—70 in FIG. 2, for example) is greater than the width of the inlets to grease removal devices.

Perhaps it should be mentioned here that it is desirable that the make-up air supplied by blower 19 be at least sufficient to replace the majority of air exhausted by blower 21. Guidance of the supplied air by the snorkel bottom over the cooking area, aids in minimizing influence of supplied ambient air on cooking surface temperature. It also avoids an air rolling action which sometimes occurs in conventional exhaust systems under the hood adjacent the top of the filters.

In view of the foregoing, it should be recognized that the present invention is adaptable to a considerable variety of standard canopy hoods, as well as special types. Flow directors according to this invention can be readily added on to existing hood installations, as well as being included on new installations. It can eliminate problems with existing installations in the field. The high velocities are achieved where needed, but standard filter areas can still be used.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

The invention claimed is:

1. In an exhaust system for combustion products from cooking apparatus, wherein the system includes an air supply opening to supply air to an area adjacent the apparatus, and an air exhaust opening to remove air and combustion products from an area adjacent the apparatus, and grease remover means immediately downstream from said exhaust opening in a flow path from said supply opening through said area and said exhaust opening to said grease remover means, the improvement comprising:

flow director means including a pair of side walls, front crossmember means, and bottom crossmember means, said side walls having front and rear ends, the front ends being horizontally spaced by said front crossmember means secured to said side walls at the front ends of said side walls, each of said side walls having a lower margin extending upwardly as it extends forwardly from the rear end to the front end, said bottom crossmember means including a bottom wall joined to said lower margins of said side walls and extending forwardly from said rear ends and terminating behind said front crossmember means, thereby leaving an opening in the bottom frontal portion of said flow director means;

said flow director means being removably mounted in the system with said rear ends located at said exhaust opening, and said bottom wall disposed in the path of air supplied through said supply opening, to direct said supplied air forwardly away from said exhaust opening and into said area toward said bottom frontal opening, said front crossmember means, side walls and rear ends of said flow director means co-operating with said system to form a duct from said bottom frontal opening to said exhaust opening having a ratio of cross sectional area adjacent said exhaust opening to cross sectional area adjacent said frontal opening of at least 2.

2. The improvement of claim 1 wherein:

the ratio of said cross sectional areas is 6.

3. The improvement of claim 1 and further comprising:

exhaust air mover means coupled to said exhaust opening and moving air through said exhaust opening into said grease remover means at a substantially constant velocity of from 200 to 400 feet per minute, and through said bottom frontal opening at a substantially constant velocity of from 800 to 1200 feet per minute.

4. The improvement of claim 3 and further comprising:

supply air handling means coupled to said supply opening and supplying air through said supply opening sufficient to make up the majority of air moved through said exhaust opening by said exhaust air mover.

5. The improvement of claim 1 and further comprising:

fastener means attaching said director means to said system and quickly releasable for removal of said director means from said system for access to and removal of said grease remover means.

6. The improvement of claim 5 wherein:

said fastener means include a hook on said front crossmember, and a ring and a quick-release over/center clamp on said system, said ring retaining said hook and thereby securing said front crossmember, and said clamp being readily releasable to release said ring from said hook.

7. The improvement of claim 6 and further comprising:

a bottom rear flange on said flow director and received and supported in a trough in said system.

8. The improvement of claim 1 wherein:

said exhaust system includes a hood, said flow director means cooperating with said hood to form said duct.

9. The improvement of claim 8 wherein:

the width of said frontal opening and the width of said duct adjacent said exhaust opening are substantially the same but the height of said frontal opening at the termination of said bottom wall is substantially less than the dimension of said duct from the bottom of said exhaust opening to the top of said exhaust opening.

10. The improvement of claim 9 wherein:

the cooking apparatus is mounted with a portion thereof under said hood and in front of said supply opening, with the rear portion of said bottom wall above said supply opening and inclined upwardly and forwardly over the fume producing portion of said cooking apparatus toward a rear edge of said frontal opening, said rear edge being about 16 inches above the fume producing portion and less than 12 inches behind the vertical upward projection of the front of the fume producing portion.

11. The improvement of claim 10 and further comprising:

side curtains on said hood extending down and to the rear from the front of the hood and beside both sides of at least a portion of the fume producing portion of said cooking apparatus to limit roll-out of air from the path between said supply opening and over said fume producing portion.

12. The improvement of claim 9 wherein:

said hood has duct means connected to the top rear portion thereof including co-axial air supply and exhaust ducts respectively supplying air to said supply opening and removing air from said exhaust opening.

13. The improvement of claim 12 wherein:

said supply opening is a transverse, upwardly opening slot at an inside wall of the bottom rear portion of said hood.

14. The improvement of claim 9 wherein:

said hood is floor mounted and has co-axial air supply and exhaust ducts extending vertically from roof mounted air handling machines to supply and exhaust plenum inlets at a side of said hood.

15. An exhaust hood intake extension device comprising:

a pair of side walls having upper margins shaped to fit and seal against interior surfaces of an exhaust hood; a bottom wall sealed to said side walls and having a rear margin shaped to seal against an interior surface of the exhaust hood, the bottom wall extending forward and upward toward front ends of said side walls, but having a front margin spaced to the rear of front ends of said side walls whereby, upon attachment to the interior of a hood, the device is cooperable with the interior surfaces of the hood to form an intake duct.

16. The device of claim 18 wherein:

said side walls and bottom wall are shaped to fit an existing installed standard canopy hood.

17. The device of claim 15 wherein:

said upper margin of each wall includes at least two outwardly turned flanges at an obtuse angle with respect to each other.

18. The device of claim 15 wherein:

the distance from the said front margin of said bottom wall to a plane containing upper margins of said side walls is substantially less than the distance from said plane to the lower rear margins of said side walls.

19. The device of claim 15 and further comprising:

a front crossmember sealed to said side walls and cooperating with said front margin of the bottom wall to frame a lower frontal intake opening in said device.

20. The device of claim 19 and further comprising:

clamping means on said front crossmember to clamp the front portion of said device to an exhaust hood.

21. The device of claim 20 wherein:

said front crossmember includes a downwardly extending front wall at the front ends of the side walls and a bottom portion extending rearward toward said front margin of said bottom wall and cooperating with said bottom wall to form an intake slot adjacent said front wall.

22. The device of claim 21 wherein:

the distance from the rear margin of said slot to a plane containing upper margins of said side walls is substantially less than the distance from the rear margin of said bottom wall to said plane.

23. The device of claim 21 wherein:

said side walls upper margins have horizontal portions near the front ends of said side walls, the distance from the rear margin of said slot to a plane containing upper margins of said side walls is substantially less than the distance from the rear margin of said bottom wall to said horizontal portions of said side walls.

24. A method of controlling escape of fumes from the area above a processing apparatus comprising the steps of:

establishing a flow of air over the top of the apparatus from the rear toward the front and then into contaminant remover devices; and causing a substantially higher rate of said flow in lineal feet per minute at a location near the front of the apparatus than the rate at the entrance to the contaminant remover devices.

25. The method of claim 24 and further comprising the steps of:

establishing a ratio of said flow rates of at least 2.

26. The method of claim 24 and further comprising the steps of:

turning the flow at said location from a forward and upward direction to a rearward direction toward the remover devices.

27. The method of claim 26 wherein:

the rate established at said location of turning of the flow is from 800 to 1200 feet per minute.

28. The method of claim 24 comprising the step of:

establishing said flow and causing said higher rate of flow by mounting a flow director to a kitchen exhaust hood assembly.

29. The method of claim 28 and further comprising the step of latching the flow director snorkel to a standard canopy hood.

* * * * *